US005683524A

United States Patent [19]

Subramanian et al.

[11] Patent Number: 5,683,524

[45] Date of Patent: Nov. 4, 1997

[54] HIGH TEMPERATURE MELTING MOLYBDENUM-CHROMIUM-SILICON ALLOYS

[75] Inventors: P. R. Subramanian, Dayton; Madan G. Mendiratta; Dennis M. Dimiduk, both of Beavercreek, all of Ohio

[73] Assignee: The United States of America as represented by the Secretary of the Air Force, Washington, D.C.

[21] Appl. No.: 533,624

[22] Filed: Sep. 25, 1995

Related U.S. Application Data

[62] Division of Ser. No. 364,375, Dec. 27, 1994, Pat. No. 5,505,793.

[51] Int. Cl.[6] ..... C22F 1/18

[52] U.S. Cl. ..... 148/668

[58] Field of Search ..... 148/668

[56] References Cited

U.S. PATENT DOCUMENTS 4,077,811 3/1978 Burman ..... 148/668

5,330,590 7/1994 Raj ..... 148/423

FOREIGN PATENT DOCUMENTS 6-212376 8/1994 Japan ..... 148/668

6-220595 8/1994 Japan ..... 148/668

6-220596 8/1994 Japan ..... 148/668

OTHER PUBLICATIONS

Svechnikov et al., Sb.Nauchn. Tr. Inst. Metallofiz; 20:94 Akad, Nauk SSR (1964) pp. 94–107.

Massalski et al;Binary Alloy Phase Diagrams, 2d Ed, volz, pp.. 1333–1335, ASM International Materials Park, OH (1990).

Anton et al. Development Potential of Advanced Intermetallic Materials, WRDC–TR–4122, Wright Patterson AFB, OH(1990), pp. i to 259.

*Primary Examiner*—John Sheehan

*Attorney, Agent, or Firm*—Bobby D. Scearce; Thomas L. Kundert

[57] ABSTRACT

High temperature melting molybdenum-chromium-silicon alloys having good high temperature strength and specific stiffness are described which comprise Mo—Cr—Si alloys in the Mo-rich (Mo, Cr)—(Mo, Cr)$_3$Si two-phase field.

4 Claims, 3 Drawing Sheets

HIGH TEMPERATURE MELTING MOLYBDENUM-CHROMIUM-SILICON ALLOYS

This application is a division of application Ser. No. 08/364,375, filed Dec. 27, 1994 now U.S. Pat. No. 5,505, 793.

RIGHTS OF THE GOVERNMENT

The invention described herein may be manufactured and used by or for the Government of the United States for all governmental purposes without the payment of any royalty.

BACKGROUND OF THE INVENTION

The present invention relates generally to high temperature melting ternary alloys, and more particularly to high temperature melting molybdenum-chromium-silicon alloys having a wide range of desirable microstructures, excellent microstructural and morphological stability, and superior oxidation resistance at temperatures of about 1000° C. to 1500° C.

Conventional (primarily nickel-based) superalloys presently used in high temperature engine applications may be inadequate to meet temperature requirements of advanced aerospace systems. New refractory material systems with improved high temperature capability are required with low-temperature damage tolerance and high-temperature strength and creep resistance in addition to superior environmental stability. Selected ordered intermetallic compounds under consideration for high temperature application have high melting temperatures and high stiffness, low densities, and good strength retention at elevated temperatures, but, in monolithic form, have inadequate damage tolerance and extremely low fracture toughness at low temperatures.

The invention solves or substantially reduces in critical importance problems associated with conventional high temperature alloys for engine applications by providing high melting molybdenum-chromium-silicon (Mo—Cr—Si) alloys and method for making them, the novel alloys of the invention comprising a ductile, refractory phase uniformly distributed within a high temperature melting intermetallic matrix, wherein the two phases are in stable thermochemical equilibrium at or above 1500° C., and wherein plasticity of the ductile phase substantially enhances the overall fracture resistance of the alloy and the matrix has good high-temperature strength and creep resistance.

It is therefore a principal object of the invention to provide improved high temperature melting molybdenum-chromium-silicon alloys.

It is a further object of the invention to provide improved molybdenum-chromium-silicon alloys having a wide range of desirable microstructures.

It is another object of the invention to provide improved molybdenum-chromium-silicon alloys having excellent microstructural and morphological properties.

It is another object of the invention to provide molybdenum-chromium-silicon alloys having superior oxidation resistance at temperatures from 1000° C. to 1500° C.

It is yet another object of the invention to provide molybdenum-chromium-silicon alloys having good low temperature toughness and good high temperature strength and creep resistance.

It is yet another object of the invention to provide improved high temperature melting molybdenum-chromium-silicon alloys for advanced aerospace propulsion systems and air vehicles.

These and other objects of the invention will become apparent as a detailed description of representative embodiments proceeds.

SUMMARY OF THE INVENTION

In accordance with the foregoing principles and objects of the invention, high temperature melting molybdenum-chromium-silicon alloys having good high temperature strength and specific stiffness are described which comprise Mo—Cr—Si alloys in the Mo-rich (Mo, Cr)—(Mo, Cr)$_3$Si two-phase field.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
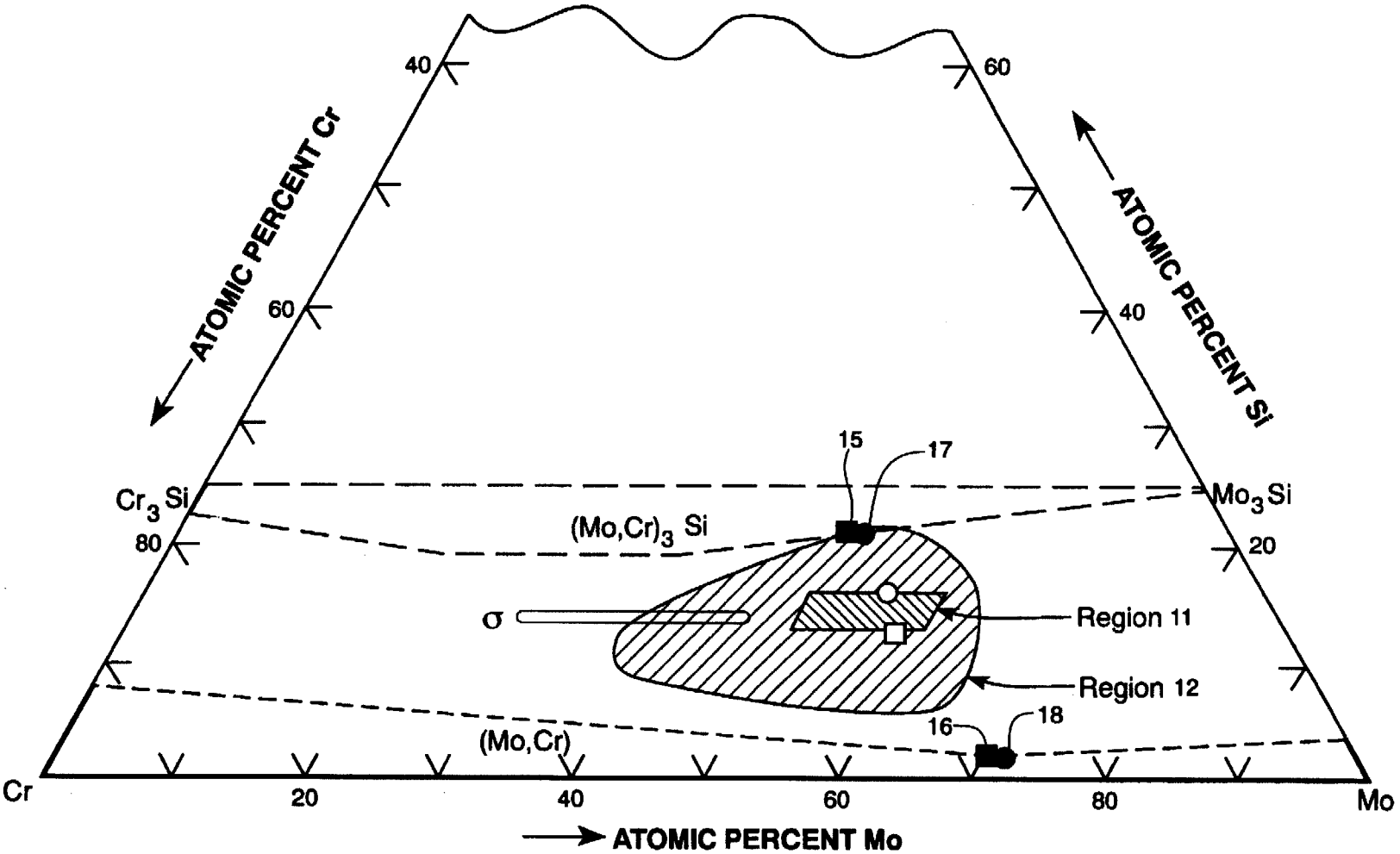
FIG. 1 shows the ternary isotherm phase diagram of the Mo—Cr—Si system at 1500° C. including the regions defining the alloys of the invention.

Referring now to the drawings, FIG. 1 shows a ternary isotherm phase diagram (based on data at 1300° C. from Svechnikov et al, *Sb. Nauchn. Tr. Inst. Metallofiz.*, 20: 94, Akad, Nauk SSR (1964) and data of the inventors herein at 1200° C. and 1500° C.) for the Mo—Cr—Si system at 1500° C., on which region 11 defined by the improved alloys of the invention is superimposed. The (Mo,Cr)$_3$Si phase exhibits continuous solid solubility between Cr$_3$Si and Mo$_3$Si and is in equilibrium with the terminal (Mo,Cr) solid-solution phase over a large composition field. The Cr-rich end of the Cr—Si phase diagram (Massalski et al, *Binary Alloy Phase Diagrams*, 2d Ed, Vol 2, 1333–5, ASM International, Materials Park OH (1990)) has a wide two-phase field between the terminal Cr solid solution and the intermetallic phase Cr$_3$Si. The two-phase field is stable to about 1705° C. (the Cr phase melts at 1863° C.; Cr$_3$Si melts at 1825° C.). Addition of Mo improves creep resistance of the Cr$_3$Si phase over that of the binary intermetallic compound (Anton et al, *Development Potential of Advanced Intermetallic Materials*, WRDC-TR-90-4122, Wright Patterson AFB OH (1990)).

Mo—Cr—Si alloys according to the invention contain a ductile phase for low-temperature damage tolerance and a high-melting intermetallic phase for high-temperature strength and creep resistance, and may contain sufficient silicon to form a protective silica-based external scale upon exposure to air at high temperature. In demonstration of the invention, Mo—Cr—Si alloys were prepared having the nominal compositions (atom percent) listed in TABLE I. Alloys (1) and (2) had Mo:Cr atom ratios of 2.0 and different Si concentrations and were prepared as 250-gram buttons by arc melting the constituent elements under purified argon in a water-cooled copper hearth using a non-consumable tungsten electrode. Samples sectioned from the buttons were annealed first at 1500° C. for 100 hours and then at 1200° C. for 100 hours. In order to minimize oxygen and nitrogen contamination, the annealing steps were performed with the samples wrapped in tantalum foil and under flowing argon, which was first gettered over titanium chips heated to 800° C. Samples were examined metallographically using standard techniques.

TABLE I

| Alloy | Phase | T = 1500° C. | T = 1200° C. |
|---|---|---|---|
| (1) 56Mo—28Cr—16Si | A | 71.4Mo—25.9Cr—2.7Si | 71.2Mo—26.4Cr—2.4Si |
| | B | 51.2Mo—27.9Cr—20.2Si | 51.1Mo—28.0Cr—20.9Si |
| (2) 58Mo—29Cr—13Si | A | 70.4Mo—26.8Cr—2.8Si | 69.2Mo—28.2Cr—2.6Si |
| | B | 50.1Mo—28.7Cr—21.2Si | 49.3Mo—29.6Cr—21.1Si |
| (3) 57Mo—30Cr—13Si | A | 72.6Mo—24.6Cr—2.8Si | |
| | B | 52.2Mo—26.5Cr—21.3Si | |

Figure 2A:
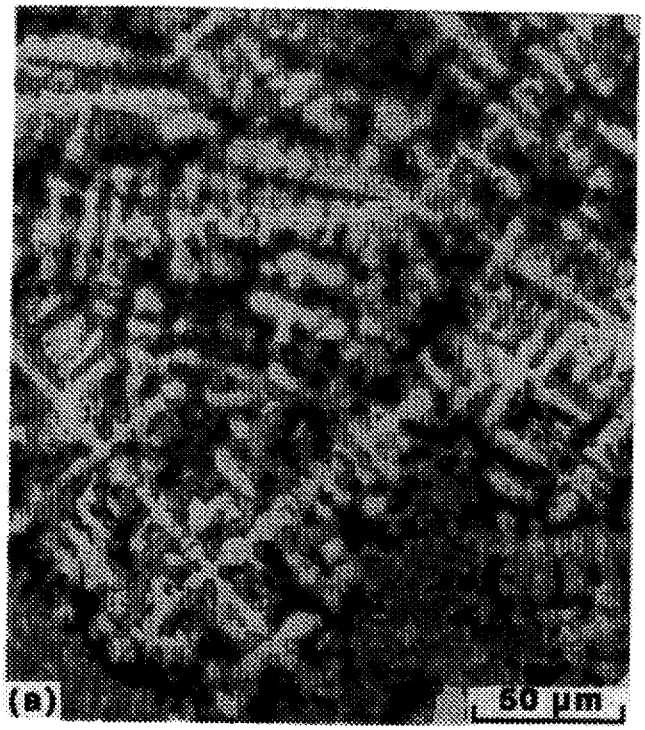
FIGS. 2*a*, 2*b*, 2*c* show backscattered scanning electron microscopy (SEM) micrographs for 58Mo-29Cr-13Si alloy according to the invention, (a) in as-cast condition, (b) after heat-treatment at 1500° C. for 100 hours, and (c) after further heat treatment at 1200° C. for 100 hours.
Figure 2B:
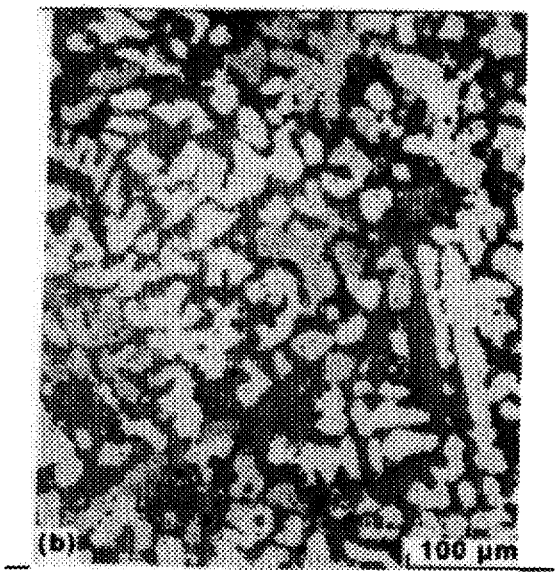
Figure 2C:
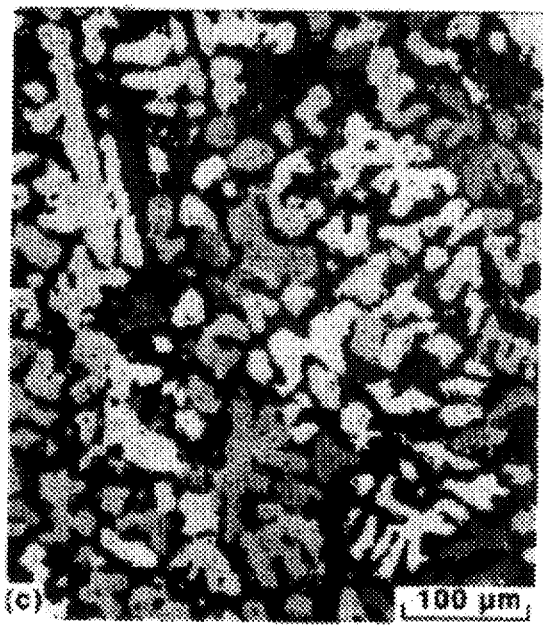

FIGS. 2*a,b,c* show backscattered SEM micrographs of Alloy (2) in (a) as-cast condition, (b) after heat-treatment at 1500° C. for 100 hours, and (c) after further heat-treatment at 1200° C. for 100 hours. Quantitative election probe microanalysis (EPMA) on Alloys (1) and (2) showed a two-phase microstructure at 1200° and 1500° C. with compositions shown in TABLE I. Phase A is a (Mo,Cr) solid solution phase with about 2.8 at % Si in solid solution and phase B is the $(Mo,Cr)_3Si$ intermetallic, Phase A appearing light and Phase B appearing dark in FIGS. 2*a,b,c* for Alloy (2). The two-phase field between (Mo,Cr) solid solution and $(Mo,Cr)_3Si$ is thermochemically stable at 1200°–1500° C. with little change in composition.

Figure 3:
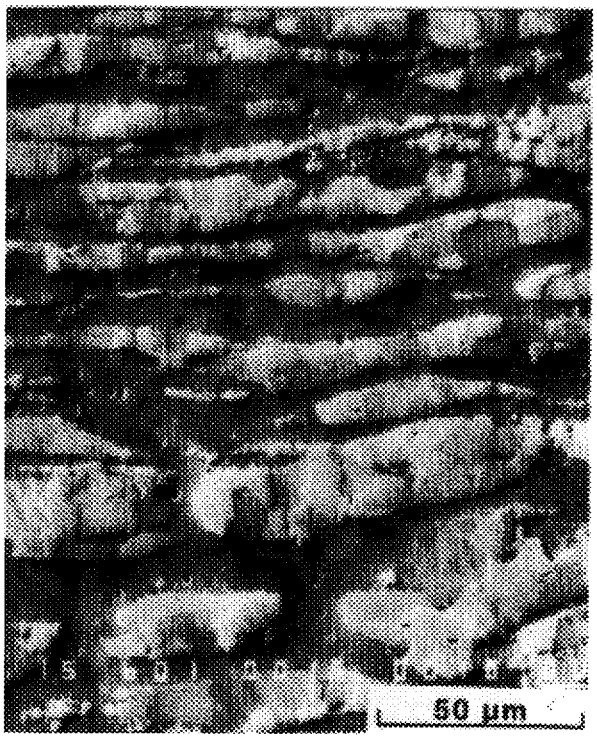
FIG. 3 is a secondary electron SEM micrograph of 57Mo-30Cr-13Si alloy of the invention in the extruded condition.

Alloy (3) was in the form of cast billets (~2.5 inch diam by 6 inches long) with composition within Region 11 of FIG. 1. A specimen of Alloy (3) was heat treated at 1500° C. for 100 hours. EPMA analysis identified equilibrium Phases A and B with compositions listed in TABLE I, Phase A being the (Mo,Cr) solid solution phase and Phase B being the $(Mo,Cr)_3Si$ intermetallic phase. Test thermomechanical processing on alloy samples demonstrated that alloys of the invention defined by Region 11 and Region 12 of FIG. 1 are easily hot worked as by extrusion, forging or powder metallurgy processing. For example, an Alloy (3) billet was enclosed in a molybdenum can and successfully hot-extruded at 1600° C. at a 5.85:1 extrusion ratio,. FIG. 3 shows a secondary electron SEM microstructure of alloy (3) after hot extrusion at 1600° C. and 5.81:1 extrusion ratio, wherein the matrix is $(Mo, Cr)_3Si$ intermetallic phase, and the elongated phase is (Mo, Cr) solid solution phase.

Specimens of the annealed alloys were tested for oxidation resistance by exposure in an air furnace at 1200° C. for 24 hours. The oxidized alloys exhibited a uniform and continuous green oxide surface layer rich in Cr. The metal recession rates for Alloys (1) and (2) were determined to be 8.1 μm/h (0.32 mils/h) and ~36 μm/h (~1.4 mils/h), respectively. Results showed the optimum Si concentration in the Mo-rich (Mo,Cr)—$(Mo,Cr)_3Si$ two-phase field to be about 13–14 at %. Four point bend testing of Alloy (1) indicated good high temperature strengths up to 1400° C. Fracture strengths were 625 MPa (90.5 ksi) and 535 MPa (77.6 ksi) at 1000° and 1400° C., respectively.

In consideration of the phase diagram of FIG. 1 and known properties of the elements comprising alloys of the invention, it is noted that all compositions selected within Region 11 of FIG. 1 will have microstructure, phase compositions and physical properties substantially identical to that of Alloys (1) or (2), namely, the (Mo,Cr) solid solution phase within a matrix of the $(Mo,Cr)_3Si$ intermetallic. For a fixed concentration of Si, the volume fraction of the two phases will remain reasonably the same, regardless of the Mo/Cr ratio within Region 11, as the width of the two-phase field between (Mo,Cr) and $(Mo,Cr)_3Si$ does not change for Region 11.

For any composition selected within Region 11, the compositions of the two phases are fixed for a fixed Mo/Cr ratio, as suggested in Table I and marked as solid squares 15,16 and circles 17,18 on the phase diagram of FIG. 1. Further, for small variations in the Mo/Cr ratio, compositions of the phases will change only with respect to the Mo/Cr ratio, but will remain substantially constant with respect to Si content, as suggested by the respective phase boundaries (shown as dashed lines in FIG. 1) which are nearly horizontal near Region 11.

In a portion of Region 12 of FIG. 1, correspondingly, composition of the sigma phase is not expected to vary for any composition within the three phase region, sigma+(Mo, Cr)+$(Mo,Cr)_3Si$. For compositions richer in Si than Region 11 (i.e., shaded region above Region 11), the volume fraction of the intermetallic phase is higher relative to that of the refractory solid solution phase in the microstructure for substantially the same compositions of either phase. The high-temperature strength, creep resistance and oxidation resistance will be correspondingly higher, but the fracture toughness will be lower. For lower Si content with respect to Region 11 (i.e., shaded region below Region 11), the volume fraction of the refractory (Mo,Cr) phase will be higher relative to that of the intermetallic phase, with correspondingly improved low-temperature toughness of the alloys.

The invention is generally applicable to two-phase or three-phase alloys having compositions Mo-(25–40)Cr-(13–16)Si (region 11 in FIG. 1), and to alloys with broader Mo—Cr—Si composition range, within region 12 in FIG. 1, which encompasses the two-phase fields (Mo,Cr)+$(Mo,Cr)_3Si$ and (Mo,Cr)+σ, and the three-phase (Mo,Cr)+$(Mo,Cr)_3Si$+σ phase field. The broader composition range relies on the same microstructural concept as that of Region 11, but without sacrificing oxidation resistance. Further, replacing some volume fraction of the $(Mo,Cr)_3Si$ phase with the σ phase (such as in the three-phase (Mo,Cr)+$(Mo,Cr)_3Si$+σ region) may allow the coefficient of thermal expansion of the intermetallic matrix to be tailored for better thermomechanical compatibility between the matrix and the ductile reinforcing phase and better control of the volume fraction of the beta phase in the alloy. The foregoing alloys may be modified with small amounts (0.2–1.0 wt %) of Ti, Hf and Y or other rare-earths to further improve oxidation resistance and scale adhesion, or modified with 5–10 at % Re or other refractory elements to raise the melting point, to improve oxidation resistance, and/or to improve the plasticity of the (Mo,Cr) phase so as to enhance the fracture resistance of the alloys, or modified with 3–7 at % Ge to decrease viscosity of the silica oxide layer.

The invention therefore provides improved high temperature melting alloys of molybdenum-chromium-silicon. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A method for preparing a high temperature melting molybdenum-chromium-silicon alloy having good low temperature damage resistance and high temperature strength and creep resistance to about 1500° C., comprising the steps of:

(a) preparing an alloy having a composition of molybdenum, chromium and silicon in the ranges of 25 to 40 atom percent Cr, 50 to 60 atom percent Mo and 13 to 16 atom percent Si; and (b) annealing said alloy between 1200° C. and 1500° C. to produce within said alloy a ductile refractory phase of a solid solution of Mo and Cr containing 2.4 to 2.8 atomic percent Si and an intermetallic matrix of $(Mo, Cr)_3Si$, and wherein said refractory phase is substantially uniformly distributed within said intermetallic matrix.

2. The method of claim 1 further comprising, following the step of annealing said alloy, the step of hot working said alloy at about 1600° C. to produce within said alloy the said intermetallic matrix within which said refractory phase is uniformly distributed in the form of elongated rods.

3. The method of claim 2 wherein said hot working is performed by one of extrusion, forging or powder metallurgy processing.

4. The method of claim 1 wherein the composition of said alloy contains a Mo to Cr atom ratio of about 2.0.

* * * * *